United States Patent [19]

Sato

[11] 4,273,046

[45] Jun. 16, 1981

[54] ATTACHING MECHANISM FOR INKING DEVICE OF PORTABLE LABEL PRINTING MACHINE OR THE LIKE

[75] Inventor: Yo Sato, Tokyo, Japan

[73] Assignee: Kabushiki Kaisha Sato Kenkyusho, Japan

[21] Appl. No.: 49,121

[22] Filed: Jun. 18, 1979

[51] Int. Cl.[3] ..... B41K 1/42; B41K 3/60

[52] U.S. Cl. ..... 101/348; 101/295; 101/314; 101/320

[58] Field of Search ..... 101/103, 288, 291, 292, 101/295, 314, 315, 348, 367, 320, 321

[56] References Cited

U.S. PATENT DOCUMENTS

| | | | |
|---|---|---|---|
| 3,092,021 | 6/1963 | Gruver | 101/367 |
| 3,759,178 | 9/1973 | Franchinot et al. | 101/348 |
| 4,044,677 | 8/1977 | Hamisch, Jr. | 101/348 |
| 4,051,780 | 10/1977 | Sato | 101/291 |
| 4,051,781 | 10/1977 | Nishikawa | 101/348 |
| 4,116,747 | 9/1978 | Hamisch, Jr. | 101/348 |
| 4,152,984 | 5/1979 | Utzinger | 101/292 |
| 4,194,448 | 3/1980 | Becker et al. | 101/359 |

*Primary Examiner*—William Pieprz

*Attorney, Agent, or Firm*—Ostrolenk, Faber, Gerb & Soffen

[57] ABSTRACT

The disclosure concerns an attaching mechanism for attaching and detaching the inking device of a portable label printing machine, or the like. The attaching mechanism includes a supporting device which is attached to the machine body of the label printing machine. An ink applicator having an inking roller is detachably secured to the supporting device. Stoppers are formed on the supporting device. The stoppers are each comprised of a guide section for guiding emplacing motion of the ink applicator, a stopper section for determining the extent of ink applicator insertion and a retaining section for supporting a portion of the ink applicator and for preventing its leaving the supporting device. The ink applicator is brought into engagement with the supporting device.

4 Claims, 5 Drawing Figures

ATTACHING MECHANISM FOR INKING DEVICE OF PORTABLE LABEL PRINTING MACHINE OR THE LIKE

BACKGROUND OF THE INVENTION

1. Field of the Invention

The present invention relates to an attaching mechanism for the inking device of a portable label printing machine, or the like.

2. Description of the Prior Art

In a conventional inking device of a portable label printing machine, the ink applicator carrying an inking roller is detachable from the machine in order to facilitate changing of the inking rollers which apply ink to the surfaces of types in a printing head. In the attaching mechanism for the ink applicator, projections or ribs are formed on one of either the machine body and the applicator and these projections or ribs are brought into engagement with holes or grooves which are formed in the other of the machine body and applicator. However, the known mechanisms are not satisfactory because their structures are complicated and their operation is troublesome.

SUMMARY OF THE INVENTION

It is, therefore, the principal object of the present invention to provide an improved attaching mechanism for the inking device of a portable label printing machine, or the like, which is free from the disadvantages of conventional attaching mechanisms.

A further object of the present invention is to provide such an attaching mechanism which makes attaching and detaching the ink applicator to a machine body quite easy and reliable.

Still a further object of the present invention is to provide an attaching mechanism for the inking device which is simple in structure, so that it may be produced inexpensively and be durable.

In accordance with the present invention, the attaching mechanism for the inking device of a portable label printing machine is comprised of a supporting device which is attached to the machine body of a label printing machine. An ink applicator having an inking roller is detachably secured to the supporting device. Stoppers are formed on the supporting device. Each stopper is comprised of a guide section for guiding emplacing motion of the ink applicator, a stopper section for determining the extent of ink applicator insertion and a retaining section for supporting a portion of the ink applicator and for preventing its leaving the supporting device. Means are provided for bringing the ink applicator into engagement with the supporting device.

The ink applicator is comprised of a holder and a supporting frame for carrying the inking roller. The supporting frame is detachably secured to the holder. The holder of the ink applicator is detachably fixed to the supporting device by engaging means.

BRIEF DESCRIPTION OF THE DRAWINGS

Other objects and features of the present invention will become apparent from the following description taken in connection with the accompanying drawings, in which.

DESCRIPTION OF THE PREFERRED EMBODIMENT

Referring to the accompanying drawings, an embodiment of the present invention is now described.

Figure 1:
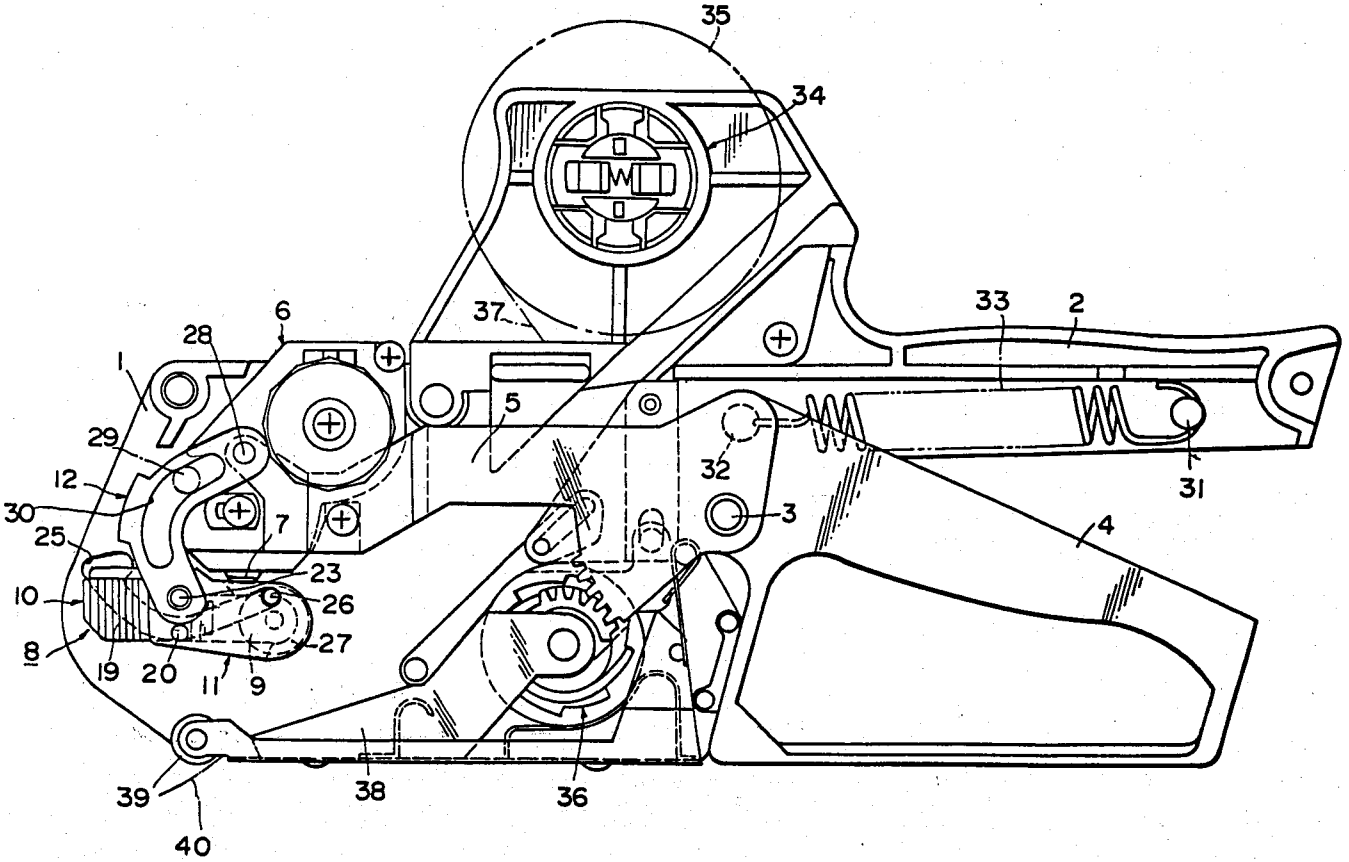
FIG. 1 is a side elevational view of a label printing machine in a stationary position and including an embodiment of the present invention.

FIG. 1 shows a portable label printing machine which is provided with an inking device 8 having an attaching mechanism of the present invention. The label printing machine includes a pair of machine frames 1 which are disposed parallel to each other with a space being defined between them. On the rear sides (to the right in FIG. 1) of the machine frames 1, the hand grip 2 is integrally formed with the frames. Between the machine frames 1, there is a hand lever 4 which is pivotally secured to the frames by a pivot shaft 3. The front portion of the hand lever 4 defines bifurcated yoke arms 5 which carry a printing head 6 at their forward free ends. The printing head has a series of printing types 7 supported on it. On the inside wall of the hand grip 2, a spring supporting pin 31 is formed. A spring supporting hole 32 is defined in the hand lever 4 above the pivot shaft 3. A drive spring 33 is stretched between the hole 32 and the spring supporting pin 31. The hand lever 4 together with the yoke arms 5 are always urged clockwise about the fulcrum of the pivot shaft 3 by the force of the drive spring 33.

The inking device 8 is comprised of an ink applicator 10 which includes a rotatable inking roller 9. A supporting device 11 detachably holds the ink applicator 10. Turning links 12 are pivotally attached at one side end thereof to the yoke arms 5 and are pivotally attached at their other side ends to the supporting device 11.

Figure 3:
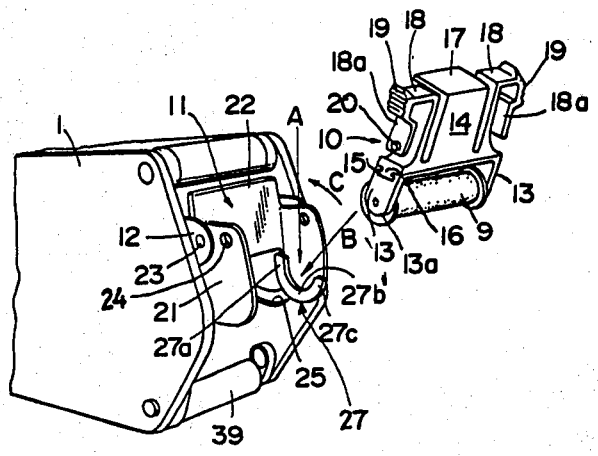
FIG. 3 is a perspective view of the main portion of the present invention showing the attaching of the ink applicator.
Figure 4A:
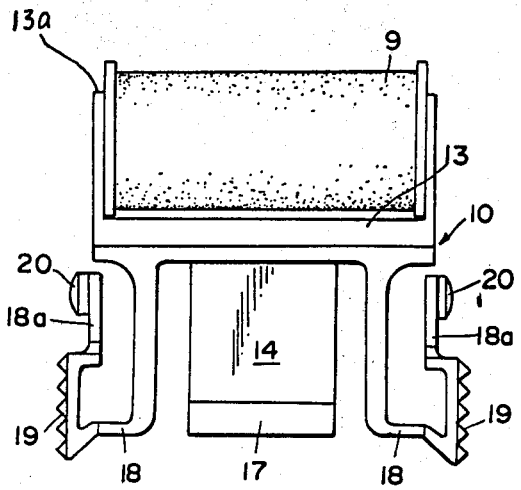
FIG. 4(A) is a front view of the ink applicator.
Figure 4B:
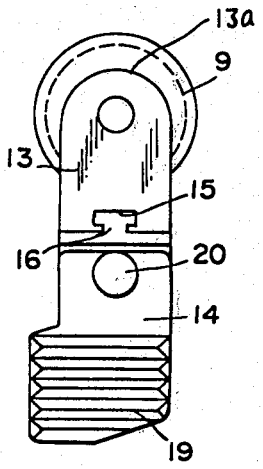
FIG. 4(B) is a side view of the same.

As shown in FIG. 3, the ink applicator 10 is comprised of a supporting frame 13 for the inking roller 9 and of a holder 14. The upper surface of the supporting frame 13 is provided with an engaging groove 15 defined in it, the cross-sectional shape of which is an inverted T. The undersurface of the holder 14 is provided with a rib which in cross-section has the shape of an inverted T. The resulting rib in groove connection detachably secures the supporting frame 13 to the holder 14. The holder 14 may be formed of a flexible material, such as plastic.

The supporting frame 13 has an L-shaped supporting plate 17 in its upper middle portion. In cross-section, the L-shape is across the axis of the roller 9. The frame 13 also has a pair of bent U-shaped pieces 18 on both sides of the L-shaped plates. In cross-section, the U-shape is along the axis of the roller 9. The upper portion of the outside tongue **18*a* of the bent piece 18 near the web of the U is provided with a ribbed or roughened surface finger piece 19. The lower portion of the outside tongue 18*a*, near the free end, is provided with an outwardly extending engaging projection 20**.

The supporting device 11 is comprised of a pair of opposed, spaced apart side walls 21 and a connecting plate 22, which connects the side walls 21. The upper end portions of the side walls 21 are pivotally secured to the turning links 12 by means of pins 23, respectively. Near to and forward of the pins 23, engaging holes 24 are formed which receive the engaging projections 20 of the holder 14. On the outsides in the other end portion of the side walls 21, guide rollers 26 are attached (see FIG. 1). The rollers 26 are rolled through guide grooves 25 defined in the inner surfaces of the machine frames 1.

On the inside surfaces in the end portions of the side walls 21, there are stoppers 27, which are curved almost in the shape of a J. Each stopper 27 is comprised of a longer guide section 27*a* at the inner or rearward side (left side in FIG. 3), a stopper section 27*b* in the middle at the web of the J and a retaining section 27*c* at the forward side. The functions of these will be described below.

When the ink applicator 10 is attached to the supporting device 11, the stoppers 27 guide the curved lower faces 13*a* of the inking roller supporting frame 13. At the same time, the stoppers 27 regulate the positions of the side walls 21.

Figure 2:
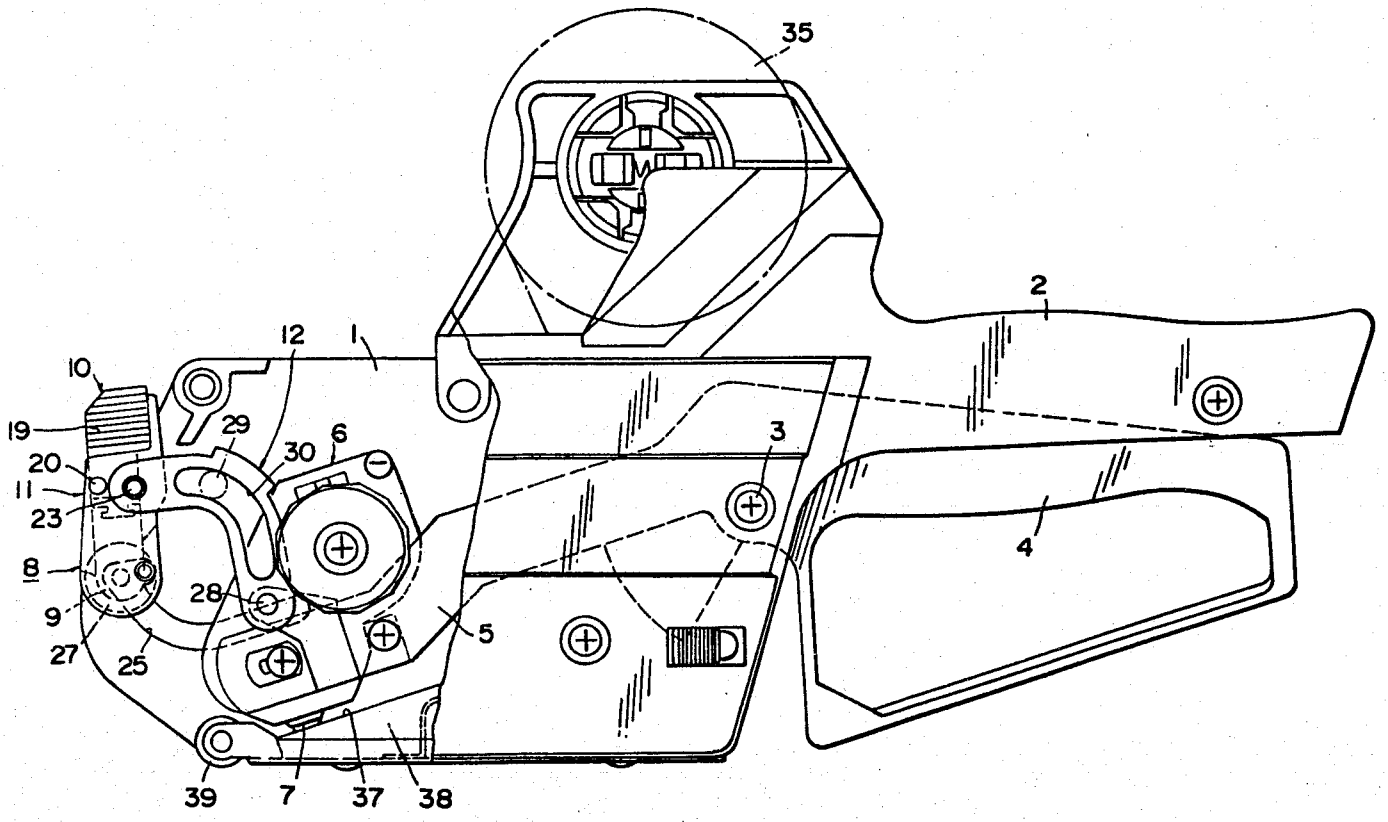
FIG. 2 is also a side elevational view of the machine in which the hand lever has been fully squeezed.

In FIGS. 1 and 2, the upper, rearward end portions of the turning links 12 are pivotally secured to the yoke arms 5 by pins 28. The lower forward end portions of the links 12 are pivotally attached to the side walls 21 by pins 23. Curved slots 30 are formed in the middle portions of the links 12. The slots are guided over the rollers 29 which project inwardly from the insides of the machine frames 1.

There is a supporting device 34, which rotatably carries the rolled label strip 35 thereon. A tape-like label strip 37 that is paid out from the rolled label strip 35 is delivered onto the platen 38 beneath the types 7 by a feeding device 36. An applying roller 39 is attached to the lower front end portion of the machine body.

The operation of the attaching mechanism for the inking device according to the present invention is now described. When the inking device 10 is attached to the portable label printing machine, the supporting device 11 is moved forward, as shown in FIGS. 2, by squeezing the hand grip 2 and the hand lever 4. Then, as shown in FIG. 3, with the inking roller 9 facing down, the finger pieces 19 of the holder 14 of the applicator 10 are pinched by the operator's finger tips and the applicator 10 is inserted into the space between the side walls 21 of the supporting device 11. The curved faces 13*a* of the supporting frames 13 are fitted against the stoppers 27. Then the finger pieces 19 are released so as to allow the outside tongues 18*a* of the bent pieces to resiliently rebound. This causes the engaging projections 20 to be fitted into the engaging holes 24 of the supporting device 11, thereby accomplishing the attaching of the ink applicator 10.

The applicator 10 can be inserted into the supporting device 11 directly from above, in the direction of arrow A, or it can be inserted from the direction of the upper front, in the direction of the arrow B. When the applicator is inserted from the upper front direction, the curved faces 13*a* first contact the guide sections 27*a* of the stoppers 27. They slide down on the guide sections 27*a* to be finally stopped by the rounded stopper sections 27*b*. Then the upper portion of the applicator 10 is pushed rearwardly in the direction of arrow C, which pivots the whole body of the applicator 10 about the center defined by the curved stopper sections 27*b* until the engaging projections 20 come into engagement with the engaging holes 24. In insertions from any direction, since the stoppers 27 are provided with retaining sections 27*c*, there is no fear that the attached applicator 10 will slip off.

When the ink contained in the inking roller is used up and the roller is to be changed for a new one, the hand grip 2 and the hand lever 4 are squeezed so as to move the supporting device 11 and the ink applicator 10 forward, in like manner as the attaching. Then the finger pieces 19 are pinched to release the engaging projections 20 from the engaging holes 24. Thus, the ink applicator 10 can easily be detached from the supporting device 11 by raising the applicator away from the stoppers.

After the applicator 10 is detached, the supporting frame 13 and the holder 14 are slid sideways from each other to disengage the engaging groove 15 from the rib 16. Then another supporting frame 13 having a new inking roller 9 is attached to the holder 14 by bringing the groove 15 into engagement with the rib 16 of the holder 14. The reassembled applicator 10 may be attached to the supporting frame 11 as described above.

The operation of the label printing machine is now described. The hand grip 2 and the hand lever 4 are first squeezed together from the stationary position of FIG. 1. As the hand lever 4 is turned upward and counterclockwise, the yoke arms 5 are also turned counterclockwise and downward about the pivot shaft 3 as shown in FIG. 2. This turns the turning links 12 clockwise about the fulcrum shafts of the pins 28. During the turning of the links 12, the slots 30 of the links are guided by the rollers 29 which are formed on the inside walls of the machine frames 1. Therefore, the ink applicator 10 on the supporting device 11 and that is pivotally attached to the turning links 12 is moved forward as the links 12 turn.

The guide rollers 26 attached to the supporting device 11 move forward through the guide grooves 25 that are formed in the inside surfaces of the machine frames 1 so that the inking roller 9 of the ink applicator 10 always moves along a definite locus. Accordingly the inking roller 9 is moved with constant pressure over the faces of the types 7 on the printing head 6. Therefore, sufficient ink can be uniformly applied to the faces of the types 7.

When the hand lever 4 is squeezed further to its full extent, as shown in FIG. 2, the yoke arms 5 are lowered further and the faces of the types 7 are brought into contact with the tape-like label strip 37 on the platen 38, thereby accomplishing the printing. The inking device 8 is at this time moved further forward and is turned up, and the supporting device 11 and the ink applicator 10 stand upright on the front side of the machine body. In this state, it becomes possible to attach and detach the ink applicator 10, as described above.

When the squeezed hand lever 4 is then released, the yoke arms 5 are turned clockwise by the drive spring 33. This action returns turning links 12 in the opposite direction to the movement in the squeezing operation, thereby returning the supporting device 11 and the applicator 10 into the state of FIG. 1.

During the return motion of the hand lever 4, the feeding device 36 is actuated which moves the tape-like label strip 37 forward. At the same time, a sheet of printed labels 40 is peeled from the backing paper of the label strip and is delivered on the underside of the applying roller 39.

In the present invention, the supporting device is provided with stoppers having guide sections, stopper sections and retaining sections, and both the supporting device and the ink applicator are provided with means to fit to each other. Therefore, the following advantages can be obtained:

(a) The attaching and detaching of the ink applicator can be carried out quite easily because the ink applicator can be inserted and attached to the supporting device from a wide number of directions. Accordingly, it can be attached or detached easily with only one hand by an operator.

(b) Since the stoppers are provided with retaining sections and the supporting device and the ink applicator are provided with engaging means, the applicator can be reliably attached to the supporting device. There need be no fear that the applicator will slip off during attachment of the applicator or during the operation of the label printing machine.

(c) Furthermore, since the structure of the attaching mechanism is simple, reduction of its production cost can be expected.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. An attaching mechanism for attaching an inking device to a label printing machine, or the like, said attaching mechanism comprising:

a supporting device which is attached to the machine body of a label printing machine;

an ink applicator; said ink applicator comprising an inking roller supporting frame having journals thereon, and an inking roller being supported to said frame on said journals;

said ink applicator also comprising a holder which includes attaching means for fixedly attaching said holder to said supporting device;

a generally J-shaped stopper on said supporting device; said J-shaped stopper being comprised of a guide section which is one leg of the J shape, said guide section being further into said supporting device so that as said ink applicator is applied to said supporting device, its said supporting frame first engages said guide section for guiding said ink applicator supporting frame to a stopper section; a stopper section being the web of the J shape, being placed for having said ink applicator supporting frame guided to it by said guide section and being shaped for halting further motion of said ink applicator as it is being applied to said supporting device; a retaining section being the other leg of the J shape, being less far into said supporting device than said guide section, and being for retaining said supporting frame in said stopper section said guide section of said generally J-shaped stopper being taller than said retaining section thereof;

said supporting frame having an end surface thereof near to said journals and which is curved in shape complementary to the curve of said stopper section; said supporting frame end surface being so shaped that with said frame on said stopper section, said supporting frame is swivelable between a position where it is nearer to said guide section and a position where it is further from said guide section; and said attaching means being positioned for attaching said holder to said supporting device following application of said ink applicator to said supporting device and following rotating of said ink applicator at said stopper section of said stopper of said supporting device toward said guide section of said stopper.

2. The attaching mechanism for the inking device as claimed in claim 1, wherein said supporting frame is fixed to said holder by means of a combination of an engaging groove on one of said supporting frame and said holder and a rib on the other of said supporting frame and said holder, and said rib engages in said groove.

3. The attaching mechanism for the inking device as claimed in claim 1, wherein said attaching means comprises said holder of said ink applicator including a resilient bent piece on it, which has an engaging projection which is biased to be fixed to said supporting device and which includes a finger piece for being operated to separate said engaging projection and said supporting device.

4. The attaching mechanism for the inking device of claim 3, wherein said attaching means further comprising an engaging hole formed in said supporting device; said engaging projection is brought into engagement with said engaging hole when said ink applicator is attached to said supporting device.

* * * * *